US006495975B2

(12) United States Patent
Yasui et al.

(10) Patent No.: US 6,495,975 B2
(45) Date of Patent: Dec. 17, 2002

(54) CRT DISPLAY APPARATUS

(75) Inventors: Hironobu Yasui, Tokyo (JP); Akinori Heishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/758,224

(22) Filed: Jan. 12, 2001

(65) Prior Publication Data

US 2002/0047667 A1 Apr. 25, 2002

(30) Foreign Application Priority Data

Aug. 29, 2000 (JP) ..... 2000-258644

(51) Int. Cl.[7] ..... H01J 29/70
(52) U.S. Cl. ..... 315/366; 315/371; 313/422
(58) Field of Search ..... 315/366, 368.11, 315/367, 370, 371, 411; 313/422

(56) References Cited

U.S. PATENT DOCUMENTS 4,980,613 A * 12/1990 Miyama et al. ..... 315/366

FOREIGN PATENT DOCUMENTS

JP 11-224618 8/1999

* cited by examiner

*Primary Examiner*—David Vu
(74) *Attorney, Agent, or Firm*—Birch, Stewart, Kolasch & Birch, LLP

(57) ABSTRACT

A CRT display apparatus including a CRT having an electron gun is disclosed. The electron gun includes a cathode, and a G1 electrode, a G2 electrode and a G3 electrode disposed in that order for drawing electrons from the cathode. The electron gun further includes a modulating electrode disposed between the G2 electrode and the G3 electrode. The CRT display apparatus is provided with a controller for controlling a value of a voltage applied to the modulating electrode in order to suppress or interrupt an electron beam flowing from the cathode to a screen of the CRT.

7 Claims, 3 Drawing Sheets

CRT DISPLAY APPARATUS

FIELD OF THE INVENTION

The present invention relates to a CRT display apparatus.

BACKGROUND OF THE INVENTION

A display apparatus with a CRT is usually provided with various protection circuits for preventing burning of a fluorescent screen or an aperture grille in a case where an excessive electron beam flows towards the screen from an electron gun, or deflection or sweep of an electron beam is stopped under fault conditions, and thereby the beam concentrates at one point on the screen.

Generally, a muting circuit is used as such a protection circuit. There are various types of muting circuit, including the one that interrupts a video signal when an abnormal condition is detected, the one that shuts off the power for a video amplifier, the one that shuts off a high-tension of an anode, and the one that shuts off the power for a heater.

In the case of muting a video signal for protection, in order to interrupt the video signal when abnormality is detected, a muting circuit is disposed for each of three channels of R, G, and B at any of a receiving unit, a preamplifier, or a cathode-amplifier in a final stage within a video circuit.

On the other hand, the demand for improving resolution of CRT display apparatuses is growing in recent years. Japanese Unexamined Patent Publication No. 11-224618 discloses a high resolution CRT (referred to as "Hi-Gm tube" hereinafter) that addresses such a demand.

An electron gun provided within a CRT has three electrodes of a cylinder form for drawing electrons from a cathode and prefocusing them, which are generally called "G1 electrode", "G2 electrode", and "G3 electrode" respectively, whereas an electron gun provided within the above-described Hi-Gm tube has, in addition to the G1, G2 and G3 electrodes, an electrode called "Gm electrode" disposed between the G2 electrode and the G3 electrode for modulating an electron beam.

FIG. 5 shows a structure of such an electron gun used for the Hi-Gm tube. In this drawing, 17 denotes a G1 electrode, 18 denotes a G2 electrode, 20 denotes a cathode, 21 denotes an electron-emitting substance formed on the surface of the cathode 20, and 22 denotes a Gm electrode. The electron gun has, for the part following the G3 electrode in which other focusing electrodes are disposed, the same structure as the conventional electron gun.

FIG. 6 is a graph showing potential distribution near the cathode of the electron gun within the Hi-Gm tube. In this graph, the horizontal axis represents the distance (mm) from the cathode surface, the vertical axis represents the potential (V), and the curve marked by 23 shows the potential distribution symmetrical with the axis of revolution near the cathode. Furthermore, the arrow marked by 24 shows the range within which the Gm electrode 22 exists, which is about 0.5 mm from the cathode surface.

The potential of the Gm electrode 22 is set to about 80 VDC, so there is a position 25 within the range at which the level of the spatial potential is minimum. If the potential of the cathode 20 shown by the dashed line is lower than the potential at this position 25, electrons pass through the position 25 and flow towards a screen. If not, electrons do not flow towards the screen since they cannot pass through the position 25.

As seen from the graph of FIG. 6, between the cathode and the position 25, electrons always exist abundantly, and the slope of the potential behind the Gm electrode 22 is of the order of $10_6$ (V/m). Compared with the potential slope between the cathode and the G1 electrode, it is greater by an order of magnitude. Therefore, after electrons pass through the Gm electrode 22, most of them can move towards the screen without being affected by spatial charges, so the intensity of the electron beam flowing to the screen is determined by the quantity of the electrons that pass through the position 25 where the spatial potential is minimum.

For this reason, variation of the intensity of the electron beam when the cathode potential is varied by a certain value in the Hi-Gm tube is about twice as much as that in the conventional CRT. That is, the variation of the cathode potential required to vary the intensity of the electron beam by a certain value in the Hi-Gm tube is less than half the variation required in the conventional CRT. In other words, with the Hi-Gm tube, the variation of the intensity of the electron beam can be doubled for the same variation of the cathode potential. Consequently, with the Hi-Gm tube it is possible to easily adapt to video signals of high frequency.

OBJECT AND SUMMARY OF THE INVENTION

However, in the above-described Hi-Gm tube, an electron beam flowing to the screen when the cathode voltage falls abnormally in the event of failure will be much greater, and a spot beam which occurs if deflection or sweep of an electron beam is stopped abnormally will be much greater compared with those in the conventional CRT. Accordingly, a spot burning of a fluorescent screen or a burning of an aperture grille can occur more easily than ever before.

In the case of carrying out the protection by muting a video signal, a muting circuit is provided for each of R, G, and B channels individually. However, since there is variation in operation timings and signal attenuation levels among such muting circuits, it is not necessarily possible to obtain desired protection by such muting circuits in the case of using the Hi-Gm tube.

An object of the present invention is to prevent occurrence of a spot burning of a fluorescent screen and a burning of an aperture grille of the Hi-Gm tube provided with an electron gun having a Gm electrode.

This object is achieved by a CRT display apparatus including a CRT having an electron gun; the electron gun including:

- a cathode;
- a G1 electrode, a G2 electrode, and a G3 electrode disposed in that order for drawing electrons from the cathode; and
- a modulating electrode disposed between the G2 electrode and the G3 electrode;
- wherein the CRT display apparatus is provided with a controller for controlling a value of a voltage applied to the modulating electrode in order to control intensity of an electron beam flowing from the cathode to a screen of the CRT.

The controller may include:

- a generator generating a protection signal when at least one of an excessive electron beam, an overvoltage of an anode of the CRT and a stoppage of deflection of the electron beam is detected; and
- a voltage source which, upon receiving the protection signal, alters a value of an output voltage of the voltage source being applied to the modulating electrode in order to suppress or interrupt the electron beam flowing from the cathode to the screen.

The controller may include a voltage source which is powered by a power supply of a deflection circuit for generating a signal used for deflecting the electron beam flowing from the cathode to the screen, and generates the voltage applied to the modulating electrode.

The controller may include a voltage source which is powered by a power supply of a video circuit for applying a voltage according to a video signal to said cathode, and generates the voltage applied to the modulating electrode.

The controller may include a voltage source which, upon receiving an image-muting signal from outside, alters a value of its output voltage being applied to the modulating electrode in order to blank out the screen.

BRIEF DESCRIPTION OF THE DRAWINGS

Embodiments of the invention will now be described by way of example and with reference to the accompanying drawings in which.

DESCRIPTION OF THE PREFERRED EMBODIMENTS

Figure 1:
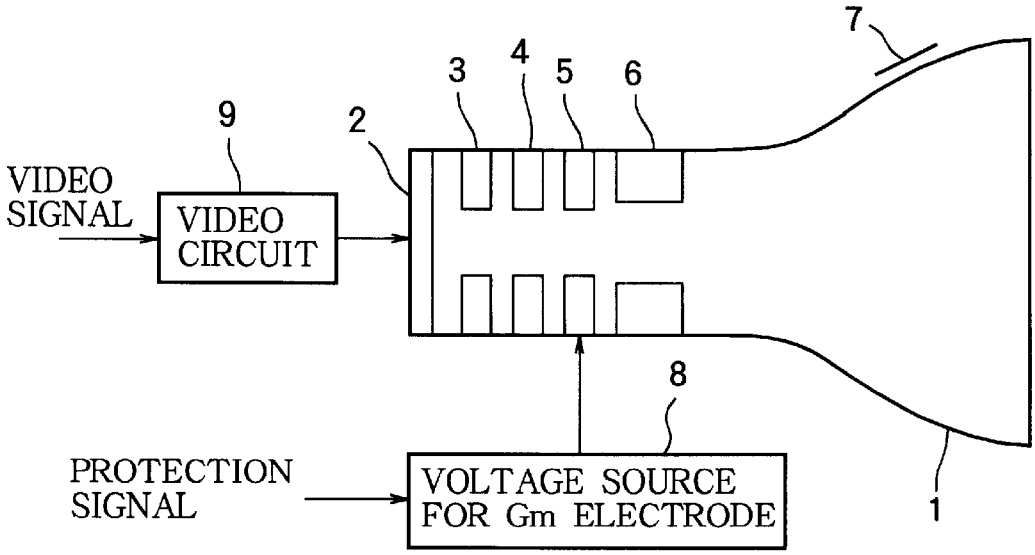
FIG. 1 shows a structure of a first example of the CRT display apparatus according to the invention.

FIG. 1 shows a structure of one example of the CRT display apparatus according to the present invention. In the FIGURE, there is shown a Hi-Gm tube 1, a cathode 2, a G1 electrode 3, a G2 electrode 4, a Gm electrode 5, a G3 electrode 6, an anode 7, a voltage source 8 for applying a voltage to the Gm electrode 5, and a video circuit 9. The Hi-Gm tube has, for the part following the G3 electrode 6, the same structure as the conventional CRT and therefore, it is not shown in the drawing to simplify the explanation.

A video signal is reversed and amplified in the video circuit 9, and is supplied to the cathode 2. A high tension produced by a flyback transformer and the like is applied to the anode 7. Under normal operation, the G1 electrode 3 is applied with 0V, the G2 electrode 4 is applied with 500V, the Gm electrode 5 is applied with 80V, the G3 electrode 6 is applied with 5.5KV, and the anode 7 is applied with 25KV, for example.

If the voltage applied to the Gm electrode 5, which defines a threshold cathode voltage of start of luminescence at the screen, is changed from 80V to a voltage below the cathode voltage range, for example, changed to 0V, the potential in the proximity of the Gm electrode 5 becomes lower than the cathode potential, so that the electron beam is interrupted and the luminescence at the screen ceases.

In this example, when a sensor (not shown) detects an excessive electron beam, an excessive increase of the anode voltage, or a stoppage of deflection of the electron beam, etc., a protection signal is given to the voltage source 8 of the Gm electrode, whereby the voltage which the voltage source 8 applies to the Gm electrode 5 changes from 80V to a voltage below the cathode voltage range, 0V for example, to interrupt the electron beam. Consequently, burning of a fluorescence screen or an aperture grille can be prevented. The above-described voltage control over the Gm electrode 5 can be performed for electron guns of R, G, and B channels at once.

Sine the response of the electron beam to the voltage change of the Gm electrode 5 is fast, and the basis of the electron beam is controlled directly, reliable and effective protection can be realized by the above-described voltage control over the Gm electrode 5.

Figure 2:
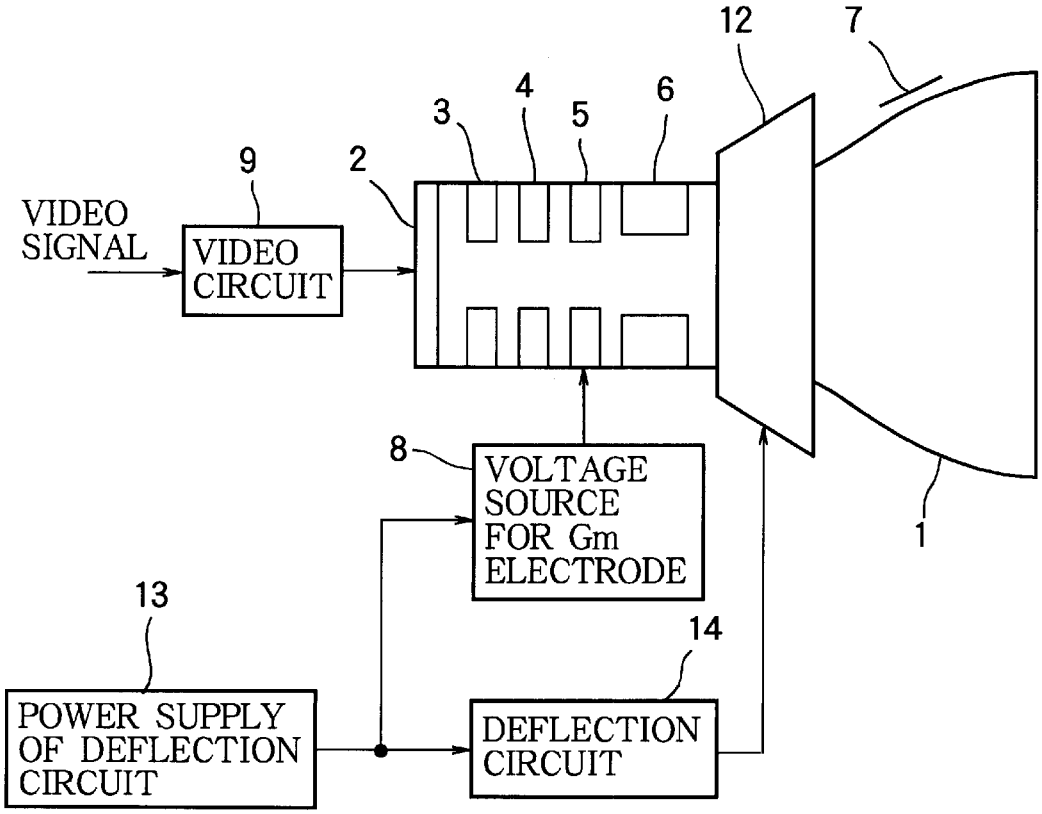
FIG. 2 shows a structure of a second example of the CRT display apparatus according to the invention.

FIG. 2 shows a structure of a second example of the CRT display apparatus according to the present invention. In the FIGURE, reference numerals identical to those in FIG. 1 represent the same elements. Although illustration is omitted in FIG. 1, the Hi-Gm tube 1 is provided with a deflection yoke 12 for sweeping on a screen the electron beam which flows from the cathode 2 to the anodes 7, a deflection circuit 14 for supplying a scanning signal to the deflection yoke 12, and a power supply 13 for this deflection circuit 14.

In this example, the output of the power supply 13 of the deflection circuit 14 is connected to the voltage source 8 of the Gm electrode 5, so that the voltage source 8 of the Gm electrode 5 is powered by the power supply 13 of the deflection circuit 14. That is, the power supply 13 of the deflection circuit 14 serves also a power supply of the voltage source 8 of the Gm electrode 5.

In a case where the output of the power supply 13 of the deflection circuit 14 is short-circuited due to a short circuit of the deflection circuit 14, a short circuit of the deflection yoke 12 or a short circuit of the power supply 13, deflection or sweep of the electron beam flowing from the cathode 2 to the anode 7 within the Hi-Gm tube 1 is stopped. In such a case, the electron beam is interrupted instantaneously because the input of the voltage source 8 of the Gm electrode 5 (output of the power supply 13 of the deflection circuit 14) as well is short-circuited and the voltage applied to the Gm electrode 5 becomes 0V in the second example.

With such an arrangement, since the electron beam is interrupted by controlling the voltage applied to the Gm electrode 5 the moment the condition which will cause stoppage of the deflection or sweep of the electron beam (short circuit of the power supply 13) occurs before the stoppage of the deflection or sweep of the electron beam is detected by a sensor, it is possible to prevent a spot burning of a fluorescent screen or a burning of an aperture grille due to delay between the instant of the detection by the sensor and the instant of execution of the control. Furthermore, the above-described arrangement constitutes a fail-safe system to provide a reliable protection.

The second example does not require an abnormality-detecting circuit (sensor) and a circuit for inputting the protection signal into the voltage source 8 of the Gm electrode which are required for the first example 1, and therefore, the cost of manufacturing can be reduced.

It is also possible to combine the second example with the first example to enable carrying out protective operation by controlling the voltage applied to the Gm electrode 5 when abnormality other than the short circuit of the power supply 13 of the deflection circuit 14 has occurred.

Figure 3:
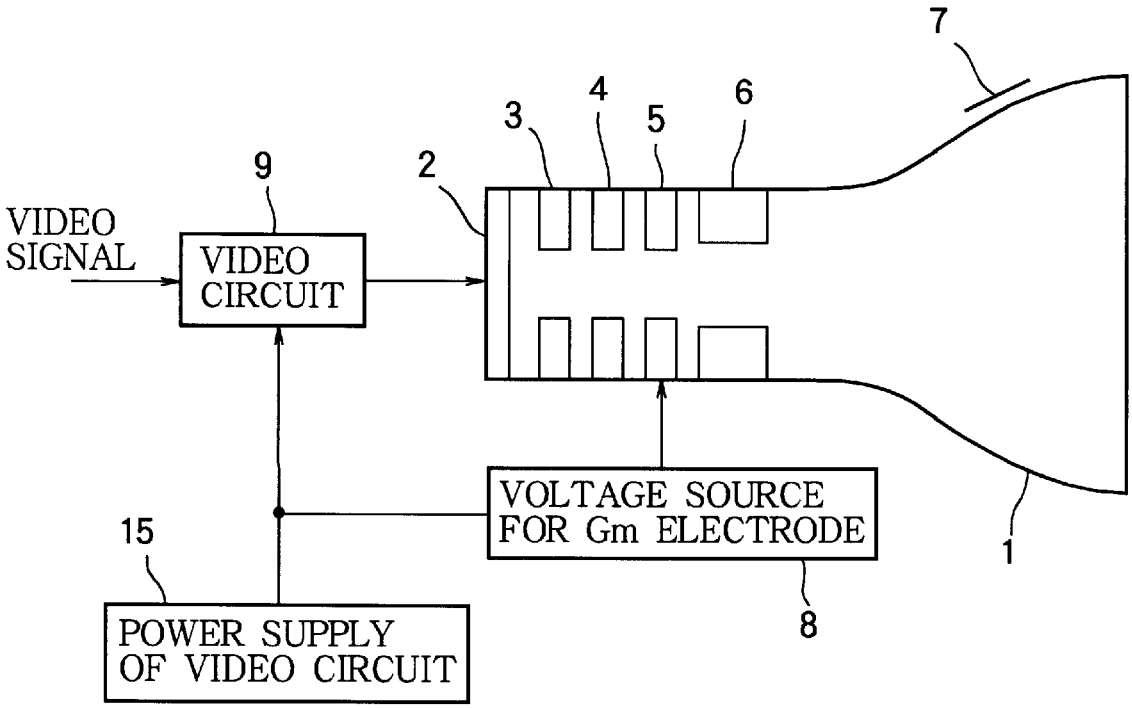
FIG. 3 shows a structure of a third example of the CRT display apparatus according to the invention.

FIG. 3 shows a structure of a third example of the CRT display apparatus according to the invention. In the FIGURE, reference numerals identical to those in FIG. 1 represent the same elements. In this example, the output of a power supply 15 that supplies a bias voltage for the cathode 2 to the video circuit 9 is connected to the voltage source 8 for the Gm electrode, so that the voltage source 8 for the Gm electrode is powered by the power supply 15 of the video circuit 9. That is, the power supply 15 of the video circuit 9 also serves as a power supply of the voltage source 8 for the Gm electrode.

If the output of the power supply 15 of the video circuit 9 is short-circuited due to a short circuit of the video circuit 9 or a malfunction of the power supply 15, the bias voltage is not applied to the cathode 2, and thereby the potential of the cathode 2 falls. With the arrangement of this example, since, when the output of the power supply 15 of the video circuit 9 is short-circuited, the input of the voltage source 8 for the Gm electrode (the output of the power supply 15 of the video circuit 9) as well is short-circuited, and thereby the voltage applied to the Gm electrode 5 becomes 0V, it is possible to prevent an excessive electron beam from flowing from the cathode 2 to the anode 7.

With the above arrangement, since the voltage applied to the Gm electrode 5 is controlled the moment the condition which will cause an excessive electron beam (short circuit of the power supply 15) occurs before the excessive electron beam is detected by a sensor, it is possible to prevent an overload on the screen due to delay between the instant of the detection by the sensor and the instant of execution of the control. Furthermore, the above-described arrangement constitutes a fail-safe system to provide a reliable protection.

The third example does not require an abnormality-detecting circuit (sensor) and a circuit for inputting the protection signal into the voltage source 8 for the Gm electrode which are required for the first example, and therefore, the cost of manufacturing can be reduced.

It is also possible to combine the third example with the first example to enable carrying out protective operation by controlling the voltage applied to the Gm electrode 5 when abnormality other than the short circuit of the power supply 15 of the video circuit 9 has occurred.

Figure 4:
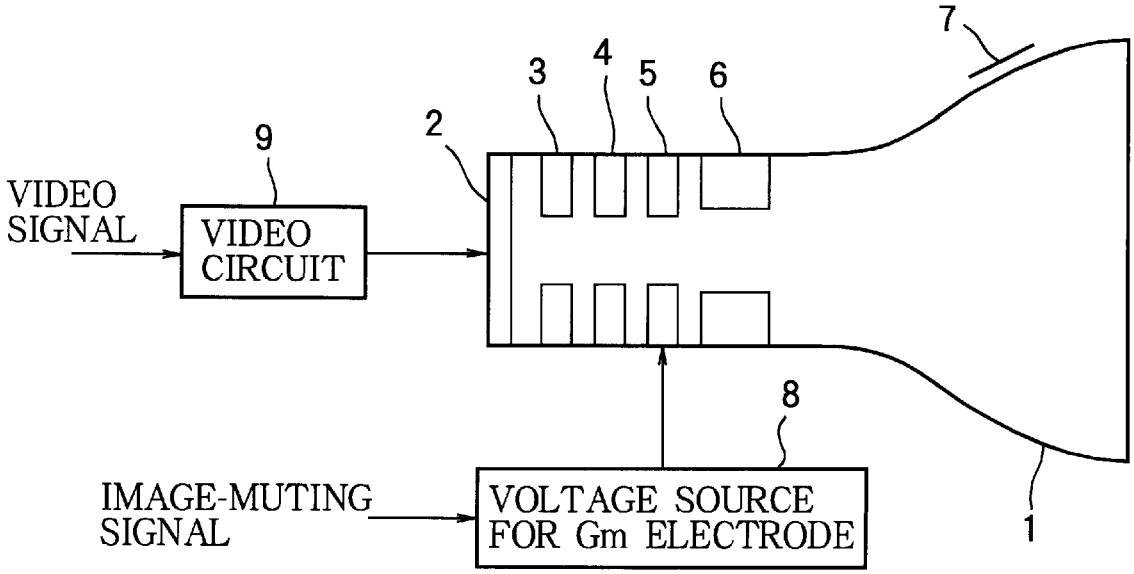
FIG. 4 shows a structure of a fourth example of the CRT display apparatus according to the invention.
Figure 5:
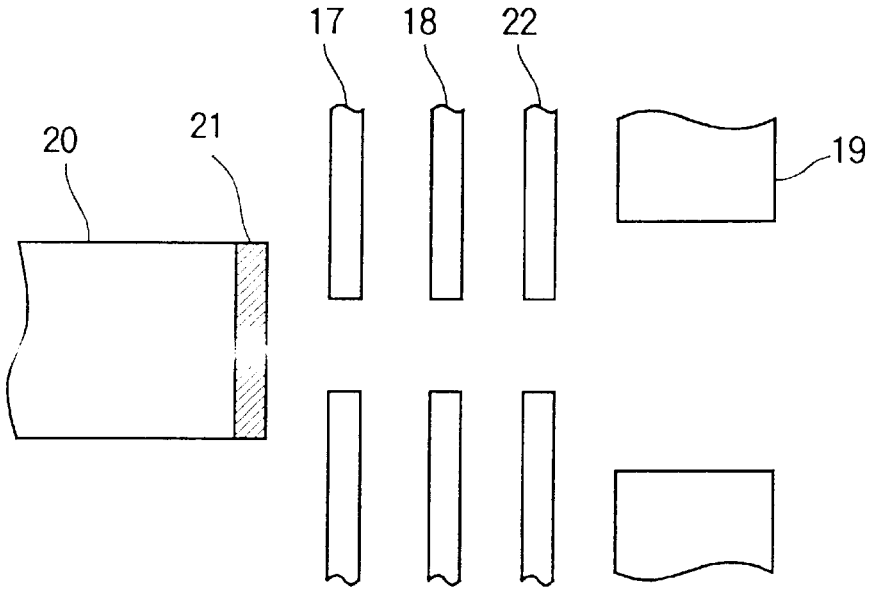
FIG. 5 PRIOR ART
FIG. 5 is a view explaining electrode structure near the cathode of an electron gun of a Hi-Gm tube.
Figure 6:
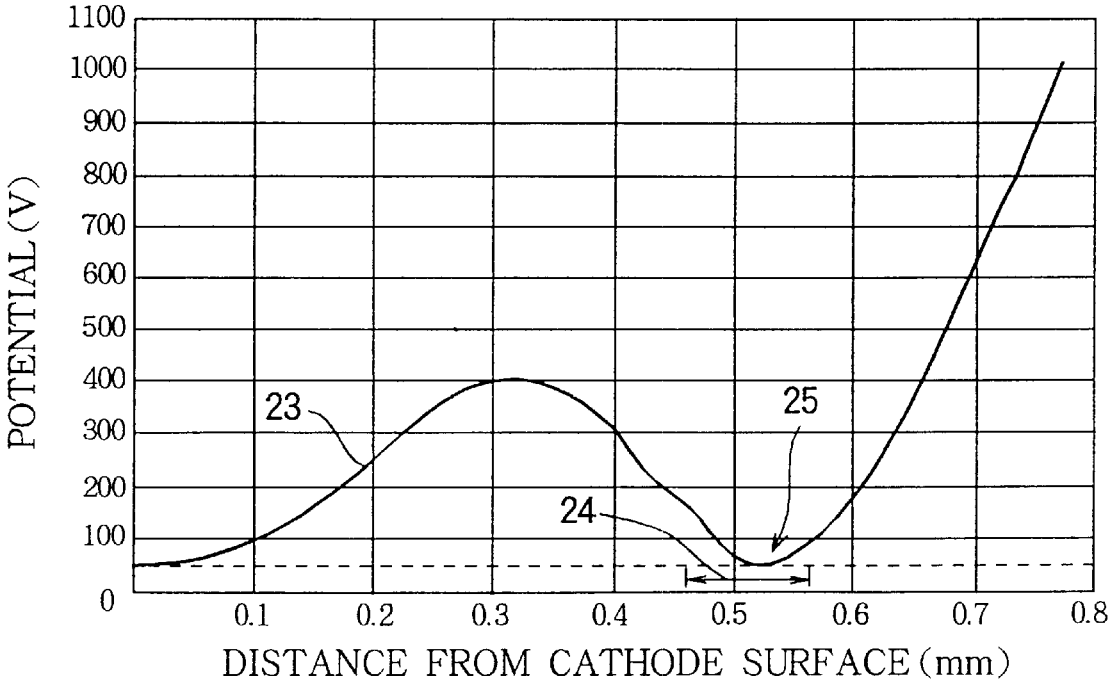
FIG. 6 PRIOR ART
FIG. 6 is a graph showing potential distribution near the cathode of an electron gun of a Hi-Gm tube.

FIG. 4 shows a structure of a fourth example of the CRT display apparatus according to the invention. In the FIGURE, reference numerals identical to those in FIG. 1 represent the same elements. In this example, an image-muting signal delivered from a muting switch (not illustrated) is supplied to the voltage source 8 for the Gm electrode to blank out the screen.

When the image-muting signal is input to the voltage source 8, the voltage applied to the Gm electrode 5 by the voltage source 8 is lowered below the voltage range of the cathode 2, for example, lowered to 0V. Accordingly, the electron beam is interrupted, and the screen is blanked out.

The conventional CRT display apparatus has a muting circuit for each of R, G and B channels within the video circuit to blank out its screen by supplying the image-muting signal to these three muting circuits. In this example, these muting circuits are unnecessary, and it is possible to control R, G and B channels at a time by just controlling the voltage applied to the Gm electrode 5. Furthermore, the muting speed is fast.

It should be also noted that by combining the fourth example with any of other examples described above, it is possible to obtain both of the image-muting function and the protecting function.

The above explained preferred embodiments are exemplary of the invention of the present application which is described solely by the claims appended below. It should be understood that modifications of the preferred embodiments may be made as would occur to one of skill in the art.

What is claimed is:

1. A CRT display apparatus including a CRT having an electron gun; said electron gun including:

a cathode;

a G1 electrode, a G2 electrode, and a G3 electrode disposed in that order for drawing electrons from said cathode; and a modulating electrode disposed between said G2 electrode and said G3 electrode;

wherein said CRT display apparatus is provided with a controller for controlling a value of a voltage applied to said modulating electrode in order to control intensity of an electron beam flowing from said cathode to a screen of said CRT.

2. A CRT display apparatus according to claim 1, in which said controller comprises:

a generator generating a protection signal when at least one of an excessive electron beam, an overvoltage of an anode of said CRT, and a stoppage of deflection of said electron beam is detected; and a voltage source which, upon receiving said protection signal, alters a value of an output voltage of said voltage source being applied to said modulating electrode in order to suppress or interrupt said electron beam flowing from said cathode to said screen.

3. A CRT display apparatus according to claim 1, further including a deflection circuit for generating a signal used for deflecting said electron beam flowing from said cathode to said screen, and a power supply for supplying power to said deflection circuit, wherein said controller comprises a voltage source which is powered by said power supply and generates said voltage applied to said modulating electrode.

4. A CRT display apparatus according to claim 1, further including a video circuit for applying a voltage according to a video signal to said cathode, and a power supply for supplying power to said video circuit, wherein said controller comprises a voltage source which is powered by said power supply and generates said voltage applied to said modulating electrode.

5. A CRT display apparatus according to claim 1, in which said controller comprises a voltage source which, upon receiving an image-muting signal from outside, alters a value of an output voltage of said voltage source being applied to said modulating electrode in order to blank out said screen.

6. A method for controlling an intensity of an electron beam flowing from a cathode to a CRT screen, comprising the steps of:

controlling a value of a voltage applied to a modulating electrode, said value determined by;

generating a protection signal when at least one of an excessive electron beam, an over voltage of an anode of said CRT and a stoppage of deflection of the electron beam is detected; and altering, upon receiving said protection signal, a value of an output voltage of a voltage source being applied to the modulating electrode.

7. The method of claim 6, wherein the value of said output voltage is altered so that the electron beam flowing from the cathode to the screen is suppressed or interrupted.

* * * * *